United States Patent [19]

Gerke et al.

[11] Patent Number: 4,822,300

[45] Date of Patent: Apr. 18, 1989

[54] CABLE WIRE CONNECTOR AND METHOD OF MAKING RAPID CABLE CONNECTIONS

[75] Inventors: Dieter Gerke; Lutz Biederstedt; Eberhard Klaiber, all of Berlin, Fed. Rep. of Germany

[73] Assignee: Krone Aktiengesellschaft, Fed. Rep. of Germany

[21] Appl. No.: 128,430

[22] Filed: Dec. 3, 1987

[30] Foreign Application Priority Data

Dec. 3, 1986 [DE] Fed. Rep. of Germany ..... 3641366
Dec. 3, 1986 [DE] Fed. Rep. of Germany ..... 3641367

[51] Int. Cl.[4] ..... H01R 4/24
[52] U.S. Cl. ..... 439/417
[58] Field of Search ..... 439/395–425

[56] References Cited

U.S. PATENT DOCUMENTS 3,868,161 2/1975 Frantz ..... 439/402
4,256,360 3/1981 Delaigt ..... 439/399
4,722,699 2/1988 Heng et al. ..... 439/396

*Primary Examiner*—Joseph H. McGlynn
*Attorney, Agent, or Firm*—McGlew & Tuttle

[57] ABSTRACT

The invention relates to a device for connecting cable wires to cutting/clamping contacts of dropwire connector banks of telecommunication sytems by means of a press-in tool provided with guide and press-in pieces and an actuating face. In order to allow a connection of a dropwire cable wire that thick insulation jacket in one single operation step to a cutting/clamping contact of the dropwire connector bank, the actuating face of the press-in tool is formed as an application body immediately adjacent to the guide and press-in pieces for a striking or lever tool, in particular a screwdriver. By exerting a striking or lever force on the press-in tool, a dropwire cable wire can, thus, be connected in one single operation step to a cutting/clamping contact of a dropwire connector bank. In a further embodiment of the invention, the press-in tool is formed as a part of the closing plug and serves for the fixation of the thin cable wires in dropwire connector banks.

7 Claims, 2 Drawing Sheets

FIG.4
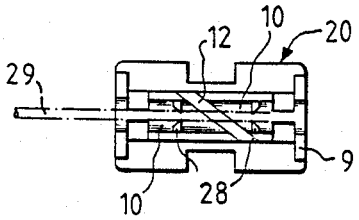
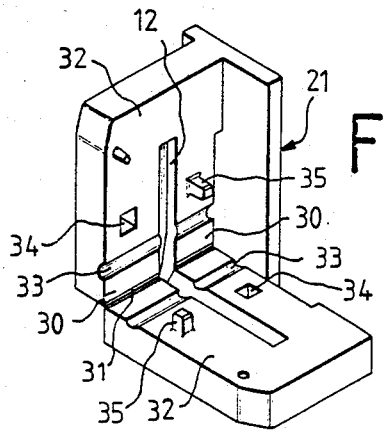
FIG.5

CABLE WIRE CONNECTOR AND METHOD OF MAKING RAPID CABLE CONNECTIONS

BACKGROUND OF THE INVENTION

FIELD OF THE INVENTION

The invention relates in general to electrical connectors and in particular to a new and useful device for connecting cable wires to cutting and clamping contacts of dropwire connector banks of telecommunication systems.

From German patent DE-PS No. 35 22 131, a similar press-in tool is known. It comprises a shaft with a handle section having a actuating face on one end and guide and press-in pieces on the other end for 'pressing-in' the cable wires into the cutting and clamping contacts of the dropwire connector bank. For dropwire cable wires having thick insulation jackets causing, thus, high press-in forces when pressing-in the dropwire cable wires into the cutting/clamping contacts of the dropwire connector bank, a pre-cutting device is arranged at the shaft of the press-in tool. This pre-cutting device comprises a U-shaped tool and two curved cutting knives disposed at the inner sides of its two side faces. Prior to being press-in into the cutting and clamping contacts, the dropwire cable wires are cut by means of the curved cutting knives at two opposed positions in the intended contacting area, and only after this cutting process, they are inserted into the respective cutting and clamping contacts of the dropwire connector bank. Pressing-in is achieved, then, by means of the press-in pieces being adapted to the shape of the cutting and clamping contact. When using the known press-in tool for dropwire cable wires, two operation steps are required, in order to reduce the high press-in forces. Furthermore, the known press-in tool is expensive in design and, thus, in manufacture.

The dropwire connector banks mentioned above are known from DE-GM No. 8121 721. Hereby, the spacings of the clamping ribs are designed to meet the thick insulation jackets of the dropwire cables. Therefore, the clamping ribs cannot hold safely thin cable wires being pressed-in by means of the press-in tools into the cutting and clamping contacts of the dropwire connector bank. It has proven, thus, that the thin cable wires can be loosened from the cutting and clamping contacts of the dropwire connector bank due to vibrations acting on the dropwire connector banks, as the relatively thin insulation jacket of the thin cable wires are not held safely by the clamping ribs of the dropwire connector bank.

SUMMARY OF THE INVENTION

The invention proves a technically simple device by which thick dropwire cable wires can be connected to cutting and clamping contacts arranged in the dropwire connector banks in one-single operation step and by which the cable wires in dropwire connector banks can be fixed safely.

In accordance with the invention a press-in tool comprises a simple and economic component, in particular of plastic, allowing the connection of dropwire cable wires with the cutting and clamping contacts of a dropwire connector bank in one single operation step; and also securing the fixation of thin cable wires in dropwire connector banks. When using the press-in tool for connecting dropwire cable wires to dropwire connector banks, the high press-in forces existing due to the thick insulation jackets of the dropwire cables are overcome by easily applicable striking or lever forces being exerted on the application body immediately adjacent to the guide and press-in pieces of the press-in tool.

In a particularly preferred manner, the press-in tool exhibits on the upper side of its application body a guide groove for the lever tool, in particular a screwdriver. The tip of the screwdriver engages under a support edge extending in a small distance above the switch side of the dropwire connector bank and laterally to the guide groove of the press-in tool. By a lever motion of the screwdriver, the press-in tool is press-in into the connector bank, whereby, simultaneously, in one single operation step the dropwire cable wire is inserted into the cutting an clamping contact. After pressing-in the press-in tool into the dropwire connector bank, the upper side of the press-in tool is disposed below the support edge of the support plate. In spite of the small height of the press-in tool, the high press-in forces can be overcome, said press-in forces arising when wiring dropwire connector banks and dropwire cable wires with the particularly thick insulation jacket.

The press-in tool comprises in particular an economically mouldable, impact-resistant plastic. Thus, at each dropwire connector bank, a press-in tool clan permanently be present by fastening it by means of a cord or the like to the dropwire connector bank.

The press-in tool of the invention can also serve as a closing plug for holding thin cable wires in the dropwire connector banks. By using the press-in tool of plastic forming a closing plug, thin cable wires can be pressed-in into the cutting/clamping contacts of dropwire connector banks and can also be held safely in the dropwire connector banks, since the press-in tool remains as a closing plug in the dropwire connector bank. As accommodation sections for the thin cable wires, holding ribs are provided on the underside of the press-in pieces of the press-in tool. In particularly preferred manner, the press-in pieces of the press-in tool are formed, however, by two snap-in half-shells connected by a film hinge, on the inner side of the half-shells, one groove-type insertion channel each being provided for accommodation of the thin cable wire. The thin cable wire is inserted into the two fold-out half-shells, and when folding back, it is fixed between the half-shells. After pressing-in the thus constructed press-in tool into the dropwire connector bank, the thin cable wire is fixed safely.

A particularly important advantage of the press-in tool forming a closing plug according to the invention is that the thin cable wire is centered by the press-in tool when inserted into the dropwire connector bank, such that a safe contact connection between the thin cable wire and the cutting/clamping contact of the dropwire connector bank is secured. It is particularly advantageous, too, that the thin cable wire is also pulled out, when the closing plug is pulled out.

Accordingly, it is an object of the invention to provide a cable wire connector which comprises a dropwire connection bank having a plurality of contacts arranged in spaced relationship each of which have cutting and electrical wire connecting portions each being arranged with a housing which includes a slot chamber overlying the cutting and electrical connecting portions which are formed to receive press-in tools which are insertable in each slot preferably a wedging surface which engage with corresponding surfaces forming the slot and wherein the tool either has a top face which is positionable alongside a support edge of the connector bank, or is formed so that it can be positioned within the slot and wedging engagement which will effect the simultaneous cutting of the insulation and connection of the electrical contact wires of the dropwires when it is inserted. A further object of the invention is to provide a method of effecting the connection of dropwires to individual contact elements of a contact connector bank and using a connector bank which has a plurality of contacts arranged in spaced relationship and each of which have cutting and electrical wire connecting portions and which uses an application tool which is insertable in a slot overlying each cutting and connecting contact, and which comprises leasing each connecting wire over the cutting and connecting contact and effecting the cutting of the insulation in a contact engagement of the wire with the contact by pressing an insertable tool into the slot from above the wire.

A further object of the invention is to provide a connector bank which is simple in design, rugged in construction and economical to manufacture.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the drawings:

FIG. 4 is a bottom plan view of a press-in tool formed as closing plug of another embodiment of the invention; and FIG. 5 is a front top perspective view of a press-in tool formed as closing plug of another embodiment with opened-up half shell portions.

DESCRIPTION OF THE PREFERRED EMBODIMENTS

Figure 1:
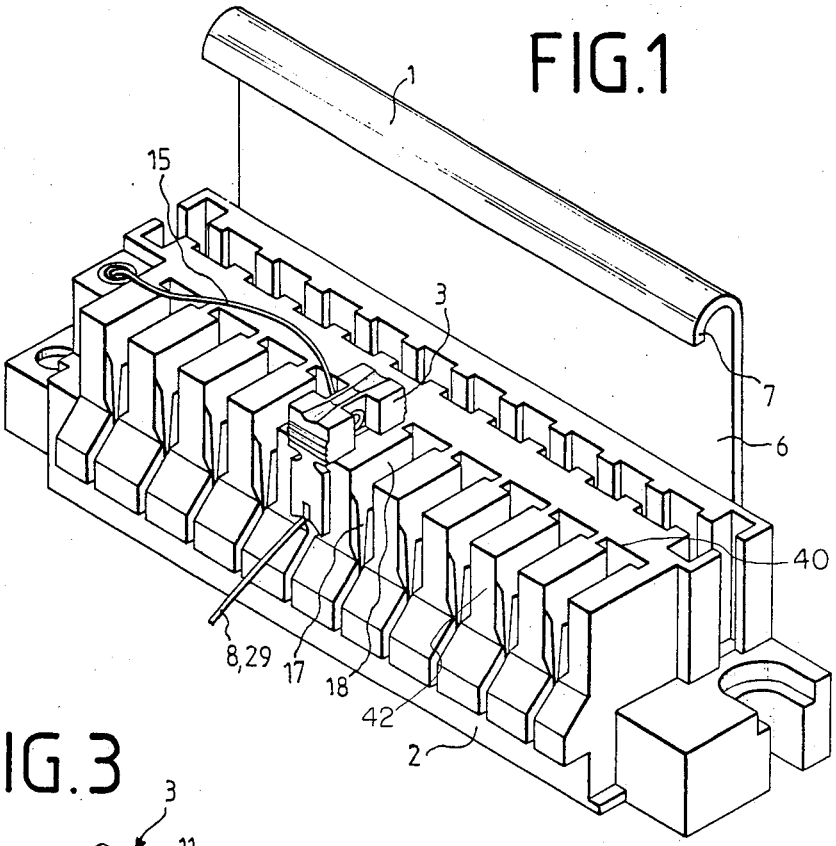
FIG. 1 is a perspective view of the device of a dropwire connector bank with inserted press-in tool constructed in accordance with the inventor.
Figure 3:
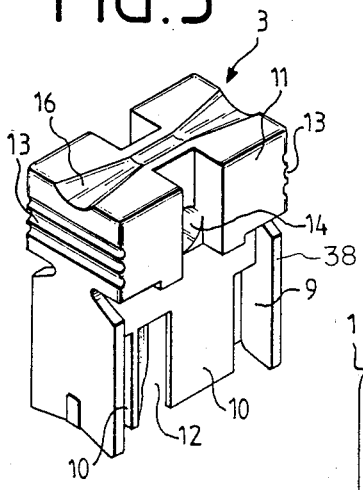
FIG. 3 is a perspective representation of the press-in tool shown in FIG. 1.
Figure 2:
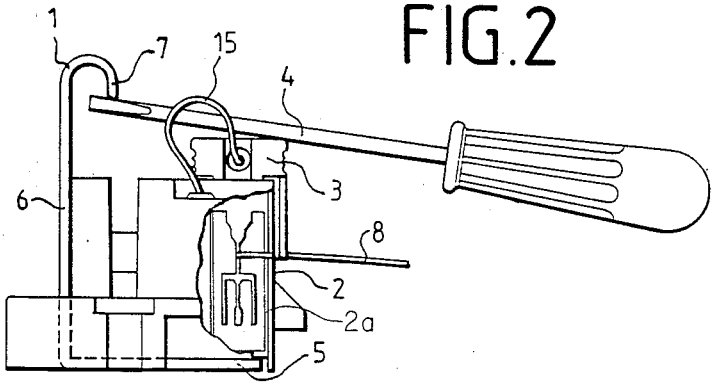
FIG. 2 is a side elevational view of the device shown on a reduced scale.

Referring to the drawings in particular the invention embodied therein in FIGS. 1–3 comprises a cable wire connector which includes a dropwire connector bank 2 having a plurality of contacts 2*a* arranged in spaced relationship, each having cutting and electrical wire connecting portions. The cutting and electrical wire connecting portions are arranged at the bottom of a wall means which defines a slot chamber 18 into which the cable wire 8 may be inserted so as to overlie each cutting and connecting portion 2*a*. Thereafter, connection is effected simply by pressing a so-called press-in tool 3 into each slot chamber 18.

The tool 3 may be positioned so as to cause wedging surfaces thereof to inter-engage wedging surfaces bounding the slot 18 by the use of a lever or striking tool 4 such as an ordinary screw- driver.

Guide portions 38 facilitate the wedging action by cooperating with guide receiving portions 40 and the planar front portion 42 g connector bank 2.

In accordance with the method of the invention in order to facilitate the wedging inter-engagement of the press-in tool 3 in the slot chamber 18 tool 4 engages a support edge 7 formed by a support plate 1 of the connector bank 2 and it may be pressed down over the top surface of the press-in tool 3 to effect wedging inter-engagement and cutting of the insulation and the connecting of the electrical wires of the cable wire 8.

The device according to FIG. 1 serves for connecting cable wires 8, 29 to cutting and clamping contacts to dropwire connector banks 2 to telecommunication systems. The cable wires 8 form so-called dropwire cable wires together with an insulation jacket which is relatively thick as compared to the wire cross section. The cable wires 29 are so-called thin cable wires, which are intended to be connected to dropwire connector banks 2 provided for dropwire cable wires 8.

The device comprises a support plate 1 with a connector bank 2 fixed on it by means of screw or snap-in connections, a press-in tool 3, 20, 21 and a lever tool in the form of a screwdriver 4. The support plate 1 of metal material or a high-strength plastic comprises a base plate part 5, on which the dropwire connector bank is mounted, and a rear wall part 6 adjacent to one side of the dropwire connector bank 2, the longitudinal side of said rear wall 6 extending upward being bent in U-shaped manner for forming a support edge 7 extending along the longitudinal axis of the dropwire connector bank 2 above its switch side.

The dropwire connector bank shown in FIG. 1 comprises ten slot chambers 18 arranged in a row. The slot chamber 18 have cutting and clamping contacts therein. Each slot chamber 18 is provided on the front of the dropwire connector bank 2 with a V-shaped clamping slot 17, the sides of which are formed by clamping ribs 17 provided with oblique clamping faces.

In the slot chamber 18 of the connector bank 2, cutting and clamping contacts are arranged which are not shown in more detail and are known from DE No. 34 15 369, and to which dropwire cable wires 8 with particularly thick insulation jacket or thin cable wires 29 are intended ,to be connected. For pressing-in the cable wires 8, 29 into the cutting and clamping contacts, the press-in tool 3 shown in FIG. 3 is provided. It comprises guide and pres-in pieces 9 and 10 adapted to the shape of the cutting and clamping contacts and to the slot chamber 18, and an application body 11 being immediately adjacent above, in particular for a striking or lever tool, in particular for a screwdriver 4. The outer shape of the press-in and guide pieces 9 and 10 corresponds to the inner shape of the slot chambers 18 provided in the dropwire connector bank 2, in the slot chambers 18 cutting and clamping contacts being arranged. In particular, a slot 12 is provided between the press-in pieces 10, into which engages the cutting and clamping contact when pressing in the cable wire 8 and 29. The application body 11 exhibits on two opposed front faces several handle grooves 13 assisting in pulling-out the press-in tool 3 from the connector bank 2 by hand or serving for pressing-in the press-in tool 20, 21 when connecting thin cable wires 29. Laterally to the application body 11, a through-hole 14 is arranged for fastening the press-in tool 3 by means of a cord 15 or the like to the dropwire connector bank 2.

On the upper side of the application body 11, a guide groove 16 for the lever tool in the form of a screwdriver 4 is provided.

For connecting a dropwire cable wire 8 to a cutting and clamping contact of the dropwire connector bank 2, the dropwire cable wire 8 is placed above the clamping slot 17 of a slot chamber 18 with associated cutting and clamping contact. The press-in tool 3 is brought into the slot chamber 18 of the clamping slot 17. Now, the dropwire cable wire 8 is ready to be pressed-in into the slot chamber 18 above the clamping slot 17. The screwdriver is inserted as lever tool according to FIG. 2 with its shaft into the guide groove 16 of the press-in tool 3, whereby the screwdriver 4 rests with its tip on the support edge 7 of the support plate 1. With the screwdriver 4 acting as lever, the dropwire cable wire 8 is, thus, pressed through the slot chamber 18 into the clamping slot 17 of the cutting and clamping contact of the connector bank 2 in on single operation step. Subsequently, the press-in tool 3 is pulled out again by hand, in order to be used for connecting another dropwire cable wire 8.

The spacing of the clamping rib 19 of a clamping slot 17 of the dropwire connector bank 2 is designed for holding dropwire cables 8 being provided with a relatively thick insulation jacket around the cable wire. For connecting the thin cable wires 29 to such a dropwire connector bank 2, the press-in tool 3 is designed as closing plug 20, 21 of plastic.

The underside of such a closing plug 20 is shown in more detail in FIG. 4 in a second embodiment of the press-in tool according to FIG. 3. The press-in tool or closing plug 20 comprises the guide piece 9 for engaging into the T-shaped slot chamber 18 of the dropwire connector bank 2 and two press-in pieces 10, between which the slot 1 for accommodation of the cutting and clamping contact not shown in more detail is recessed when pressing-in the closing plug 20 into the slot chamber 18 of the connector bank 2. The closing plug 20 is provided on the underside of its press-in pieces 10 with an accommodation section for a thin cable wire 29, the accommodation section being formed by holding ribs 28, between which the thin cable wire 29 is pressed-in when wiring, such that the thin cable wire 29 is centered when pressing-in the closing plug 20 into the slot chamber 18 of the dropwire connector bank 2. For wiring with a thin cable wire 29, the closing plug 20 can be pressed-in by hand into the slot chamber 18 of the dropwire connector bank 2 and remains in the chamber 18.

FIG. 5 shows a third embodiment of the press-in tool 3 shown in FIG. 3 and being here formed as closing plug 21. In this closing plug 21, the two press-in pieces 30, enclosing the slot 12 for the cutting and clamping contact, are formed by two half-shells 32 connected by a film hinge 31, one half-shell 32 being rigidly connected with the guide piece 9. On the inner sides of the half-shells 32, one groove-type insertion channel 33 each for accommodation of the thin cable wire 29 is provided. The thin cable wire 29 is placed with opened-up half-shells 32 into groove of the insertion channel 33, and is fixed after closing the half-shells 32 in the insertion channel 33. When closing the half-shells 32, notches 34 and latches 35 provided on them engage with each other for locking. Then, the closing plug 21 is pressed-in into the desired chamber 18 of the dropwire connector bank 2, the thin cable wire 29 being safely contacted by the cutting and clamping contact, as when pressing-in, centering by means of the closing plug 21 is effected. The closing plug 21 insertable by hand remains in the dropwire connector bank 2. When pulling the closing plug 21 out from the dropwire connector bank 2, simultaneously the thin cable wire 29 is pulled out.

What is claimed is:

1. A device for connecting dropwise cables, comprising:

a dropwise connector bank body defining a plurality of insertion slot chambers;

a plurality of cutting/clamping contacts, each of said plurality of cutting/clamping contacts being positioned within one of said plurality of insertion slot chambers;

a press-in tool including an application body, a press-in piece extending downwardly from said application body, said press-in piece being adapted to urge a dropwire cable into said cutting/clamping contact as said press-in tool is inserted into one of said plurality of insertion slot chambers;

a wall portion having a support edge, said wall portion being connected to said dropwire connector bank body;

and guide groove means connected to said press-in tool application body, said guide groove means for guidingly receiving a lever tool and for positioning the lever tool relative to said support edge to bear the lever tool against the support edge to facilitate pressing the press-in tool application body and to press the press-in piece into one of said plurality of insertion slots.

2. A device according to claim 1 wherein said press-in tool has through-hole extending translongitudinally therethrough in a cord extending through said hole.

3. A device according to claim 1, wherein said press-in tool is made of an impact resistant plastic.

4. A device according to claim 1, wherein said dropwire connector bank body includes a plurality of planar wall portion, each planar wall portion being positioned on one of two sides of an opening for a dropwire cable of one of said insertion slot chambers, each press-in tool including a second guide portion extending downwardly from said application body said second guide portion being adapted to engage at least one of said planar wall portions to cooperate with said guide portion to guide said press-in tool as said press-in piece is inserted into one of said insertion slot chambers.

5. A device for connecting dropwise cables, comprising:

a dropwise connector bank body defining a plurality of insertion slot chambers and defining a plurality of guide slot portions, each guide slot portion being positioned adjacent one of said plurality of insertion slot chambers;

a plurality of cutting/clamping contacts, each of said plurality of cutting/clamping contacts being positioned within one of said plurality of insertion slot chambers;

a press-in tool including an application body, a press-in piece extending downwardly from said application body, said press-in piece being adapted to urge a dropwire cable into said cutting/clamping contact as said press-in tool is inserted into one of said plurality of insertion slot chambers, and a guide portion extending downwardly from said application body, said guide portion being adapted to engage one of said plurality of guide slot portions;

a wall portion having a support edge, said wall portion being connected to said dropwire connector bank body;

and guide groove means connected to said press-in tool application body, said guide groove means for guidingly receiving a lever member and for positioning the lever member relative to said support edge for bearing the lever member against the support edge to press the press-in tool application body downwardly and press the press-in piece into one of said plurality of insertion slots.

6. A device according to claim 5, wherein: said press-in tool includes handle grooves positioned on sides of said application body to facilitate removing said press-in piece from one of said insertion slot chambers.

7. The method for inserting a dropwire cable in a connector assembly including a dropwire connector bank body defining a plurality of insertion slot chambers, and defining a plurality of guide slot portions, each guide slot portion being positioned adjacent one of the plurality of insertion slot chambers, a plurality of cutting/clamping contacts, each of the plurality of cutting/clamping contacts being positioned within one of the plurality of insertion slot chambers, a press-in tool including an application body, a press-in piece extending downwardly from the application body and a guide portion extending downwardly from the application body, a wall portion having a support edge, the wall portion being connected to the dropwire connection bank body and a guide groove connected to the press-in tool application body, the method comprising the steps of: aligning the press-in piece of the press-in tool with one of the insertion slot chambers and simultaneously aligning the guide portion with one of the guide slot portions corresponding to the aligned said one of the insertion slot chambers; positioning a dropwire cable above one of said insertion slot chambers; positioning a lever member in contact with the support edge of said wall member and the guide groove associated with the press-in tool; pressing the press-in tool while simultaneously bearing on the support edge using the support edge as the focrom of a lever to urge the press-in tool press-in piece into the insertion slot chamber to urge the drop-wire cable into a corresponding one of the cutting/clamping contacts.

* * * * *